US005161837A

United States Patent [19]

O'Brien II

[11] Patent Number: 5,161,837

[45] Date of Patent: Nov. 10, 1992

[54] ROD AND CASE ASSEMBLY AND PANIC EXIT DEVICE

[75] Inventor: James O'Brien II, Burbank, Calif.

[73] Assignee: Thomas Industries Inc., Builders Brass Works Div., Los Angeles, Calif.

[21] Appl. No.: 787,261

[22] Filed: Nov. 4, 1991

Related U.S. Application Data

[63] Continuation-in-part of Ser. No. 734,566, Jul. 23, 1991.

[51] Int. Cl.[5] ..... E05C 9/04

[52] U.S. Cl. ..... 292/40; 292/336.3; 292/DIG. 24; 292/DIG. 62; 292/21

[58] Field of Search ..... 292/92, 21, 184, 188, 292/166, 40, 37, 34, 165, 173, 169, 336.3, DIG. 24, DIG. 62; 70/92

[56] References Cited

U.S. PATENT DOCUMENTS

| | | | |
|---|---|---|---|
| 3,498,657 | 3/1970 | Fontana | 292/34 |
| 3,614,145 | 10/1971 | Zawadzki | 292/92 |
| 3,663,047 | 5/1972 | Zawadzki | 292/92 |
| 3,730,574 | 5/1973 | Zawadzki | 292/92 |
| 3,776,582 | 12/1973 | Balducci | 292/92 |
| 3,894,759 | 7/1975 | Balducci | 292/92 |
| 3,993,335 | 11/1976 | Schmidt | 292/21 |
| 4,083,590 | 4/1978 | Folger | 292/92 |
| 4,130,306 | 12/1978 | Brkic | 292/5 |
| 4,167,280 | 9/1979 | Godec et al. | 292/92 |
| 4,225,163 | 9/1980 | Hubbard et al. | 292/21 |
| 4,283,882 | 8/1981 | Hubbard et al. | 49/141 |
| 4,295,673 | 10/1981 | Miller | 292/21 |
| 4,368,905 | 1/1983 | Hirschbein | 292/5 |
| 4,384,738 | 5/1983 | Floyd | 292/92 |
| 4,387,917 | 6/1983 | Cocker | 292/40 |
| 4,458,928 | 7/1984 | Hirschbein | 292/92 |
| 4,488,378 | 12/1984 | Symon | 49/141 |
| 4,498,319 | 2/1985 | Balducci et al. | 70/92 |
| 4,545,606 | 10/1985 | Vodra | 292/92 |
| 4,741,563 | 5/1988 | Cohrs | 292/21 |
| 4,839,988 | 6/1989 | Betts et al. | 49/141 |
| 4,906,034 | 3/1990 | Verslycken | 292/92 |

*Primary Examiner*—Richard E. Moore

*Attorney, Agent, or Firm*—Hill, Van Santen, Steadman & Simpson

[57] ABSTRACT

A rod casing for activating vertically arranged latch bolts, the casing and latch bolts arranged in an active stile of a door and engageable to a door frame. The rod casing provides a vertically slidable actuator cam engageable by both a lock/unlock actuator and a delatch or dogging actuator. The lock/unlock actuator and the delatch actuator are rotatably mounted upon a spindle piece which itself is rotatable by a user such as by a key-activated lock cylinder. The lock-unlock actuator when rotated, slidingly abuts the actuator cam and drives the actuator cam vertically upward to cause unlatching of the latch bolts. The delatch actuator, upon rotation of the spindle piece in an opposite direction underlies the actuator cam and dogs the actuator cam in its vertically risen position. A panic exit device is also provided which has a lift plate mounted fixedly to the rod slide, the lift plate liftable by a pivoting of a lift lever, the lift lever pivoted by a lateral thrusting of a push plate slidably held beneath a push pad of the panic exit device. When compressed by a user, the push pad compresses two motion actuators housed beneath the push pad which laterally translate the push plate toward the lift lever. A spring loaded panic exit device dogging mechanism is also provided.

22 Claims, 6 Drawing Sheets

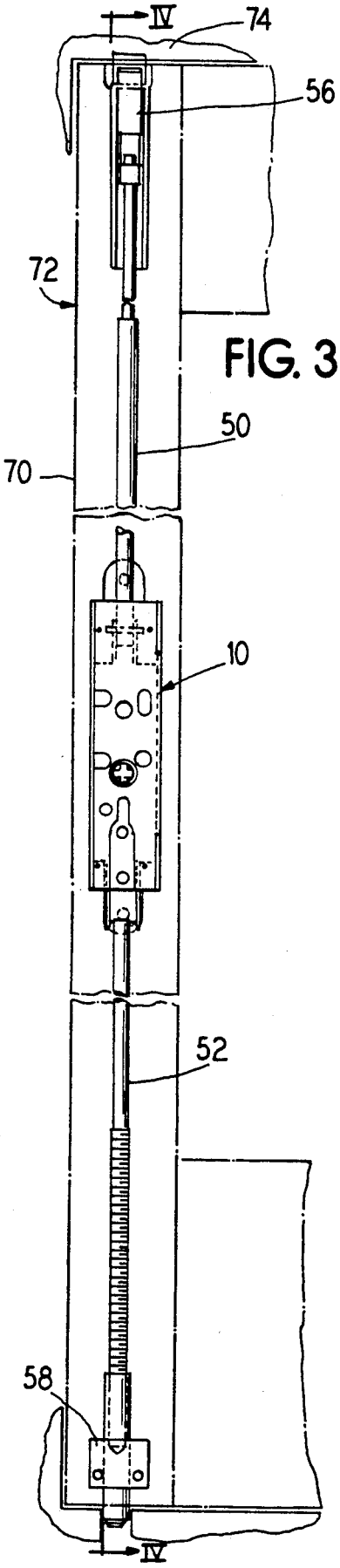
FIG. 3
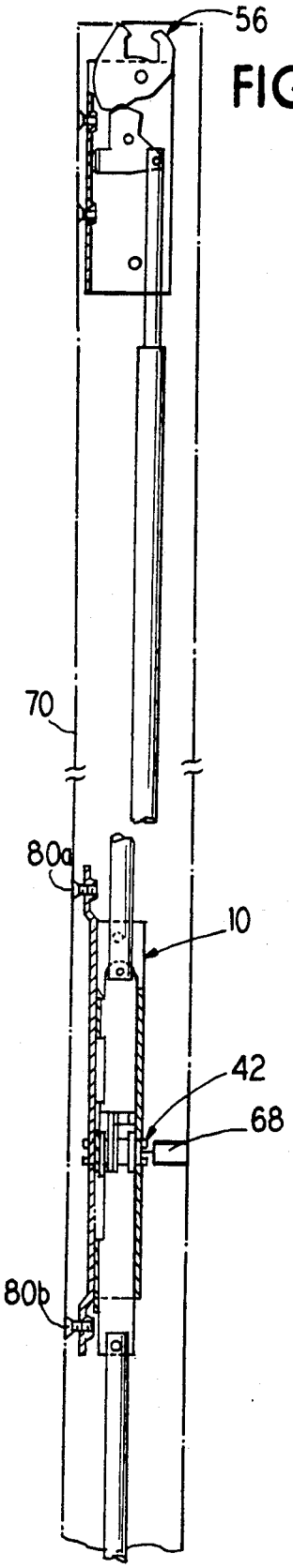
FIG. 4
FIG. 2
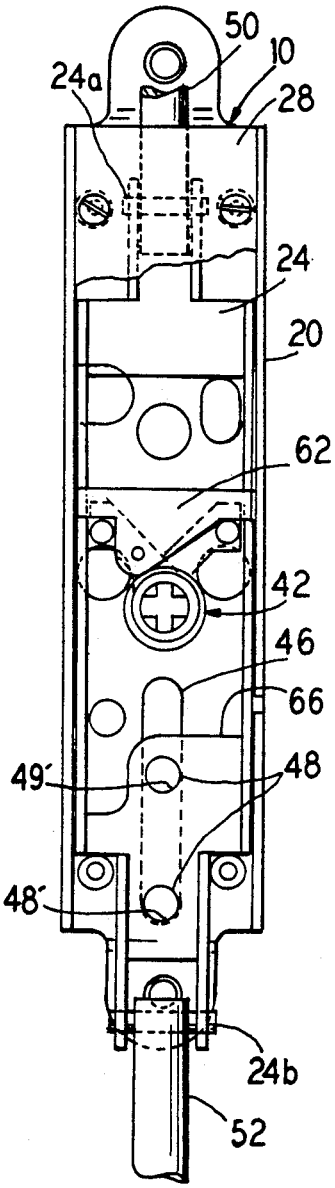

30
34
38
42
XIII
XIII 34
34b
38
38b 24
30
38b
38

24
30
38b
38

50
24
30
34b
34
42
52

30
34
34b 50
10
30
34b
30a
34
42
52
20

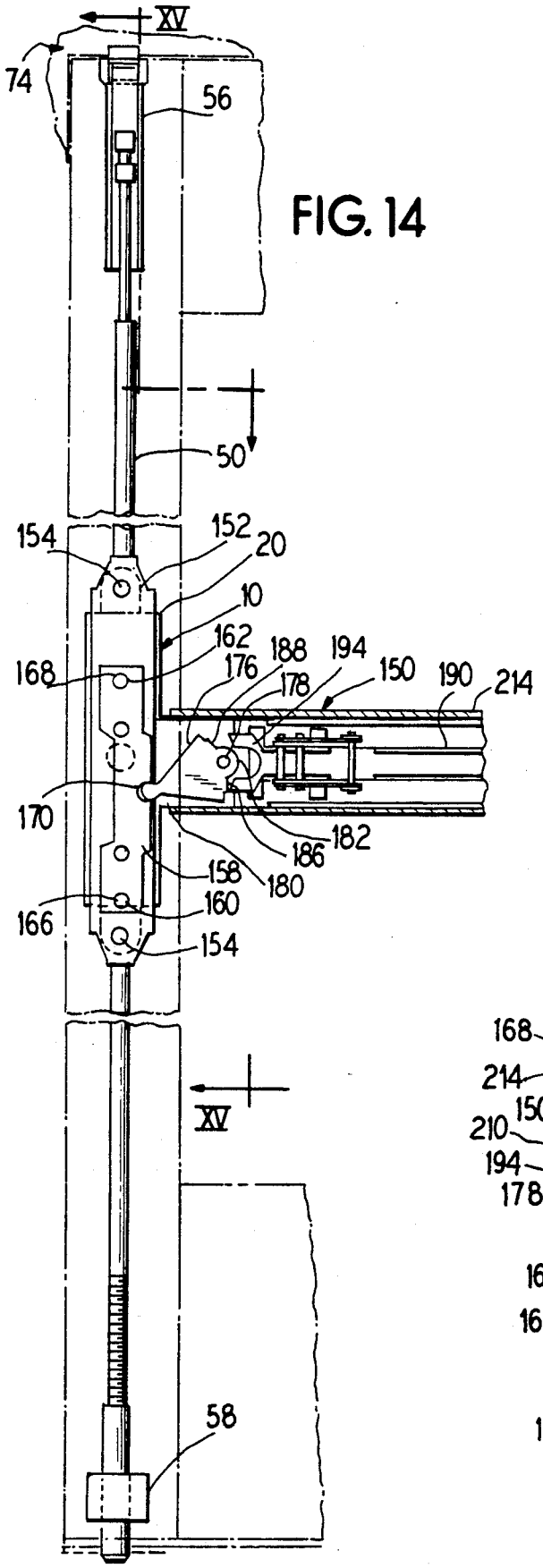
FIG. 14
FIG. 15
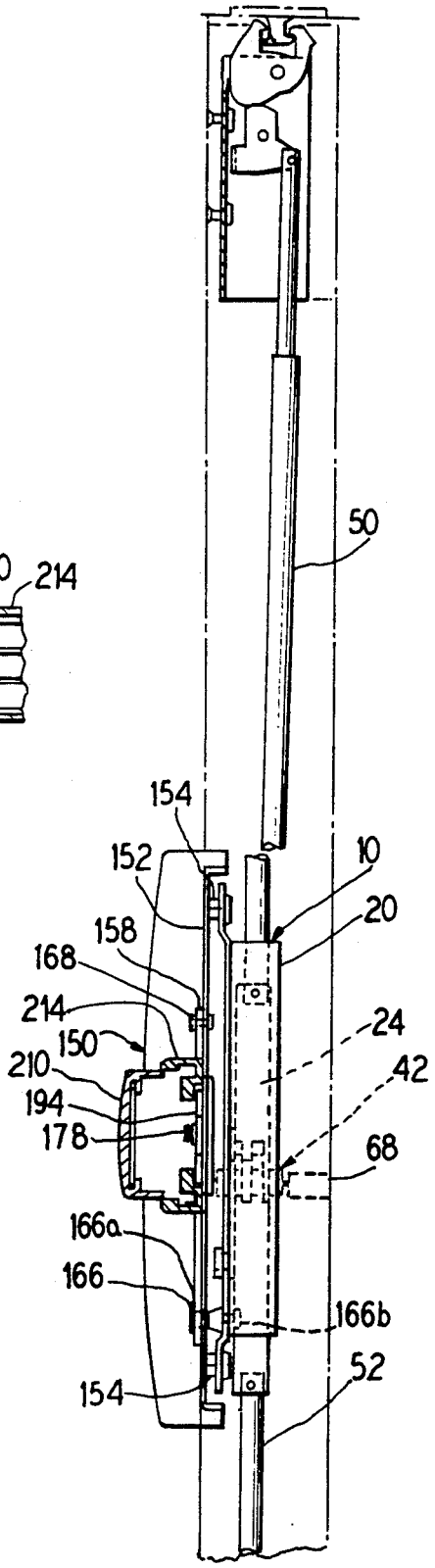

ROD AND CASE ASSEMBLY AND PANIC EXIT DEVICE

BACKGROUND OF THE INVENTION

This application is a continuation-in-part of U.S. Ser. No. 734,566, filed Jul. 23, 1991.

The present invention relates to a case assembly or mechanism for activating and deactivating vertically operating bolts extending from the top and bottom of a door stile and engageable with a door frame. In particular, the case assembly can be activated by a key and key cylinder or a panic exit bar or other device for raising a bottom bolt and retracting an upper bolt or disengaging an upper and lower latch to allow the door to freely swing open. The present invention particularly relates to a means of retracting the upper and lower latch bolts and a means for "dogging" or selectively holding the latch bolts or latches in their retracted or disengaged position.

The present invention also relates to a panic exit bar or panic exit device which utilizes a push bar for translating an inward thrust on the device to an actuation of a door latching mechanism which operates vertically arranged bolts extending from the top and bottom of a door stile engageable with a door frame. Examples of panic exit devices are disclosed for example in U.S. Pat. No. 3,993,335 or U.S. Pat. No. 4,839,988.

A variety of dogging devices are known in the prior art. These dogging devices selectively hold latches in a retracted position. Such dogging devices are disclosed, for example, in U.S. Pat. No. 3,993,335, U.S. Pat. No. 3,374,649, and U.S. Pat. No. 4,624,490.

SUMMARY OF THE INVENTION

It is an object of the present invention to provide a compact, easily manufactured, rod and case assembly for both unlocking or disengaging the upper and lower latches from a door frame and also dogging the latches in their disengaged condition.

It is an object of the invention to provide a simple, smooth operating, rugged and cost effective panic exit device in mechanical communication with the rod and case assembly to disengage the upper and lower latches from a door frame and which can provide means for dogging the panic exit device in its actuated condition.

It is an object of the invention to provide a rod and case assembly which can be dogged in the disengaged condition either by a key lock actuator or by an adjustment to the panic exit device, thus providing alternate means to dog open the latches from outside of the door or inside of the door.

It is an object of the invention to provide the rod and case assembly for installation in an active door stile of a door and provide key activation of both the unlocking feature and the dogging feature of the case and rod assembly.

It is an object of the invention to provide a simple rod and case assembly having minimum of parts.

It is an object of the invention to provide a rugged, durable rod and case assembly for unlocking and, additionally, dogging vertical latches.

The objects of the invention are inventively achieved in that a rod and case assembly is provided with a casing assembly engaged to vertically extending rods, the rods engaged to upper and lower latches for engaging and disengaging a door frame. The casing assembly provides a lock/unlock and retract cam fixed to a rod slide movable vertically within a housing. The housing is anchored within the door stile. The lock/unlock retract cam is activated by a lock/unlock actuator which can be key operated or mechanically operated, such as by a manual exit device. The lock/unlock retract cam is also engageable by a latch retract actuator which is engageable with the lock/unlock retract cam to dog the latches in a disengaged condition for convenient unlocked use of the otherwise automatically latching door.

The objects are inventively achieved in that both the latch retract actuator and the lock/unlock actuator can be engaged by a single cylinder hub for rotatable engagement and disengagement with the lock/latch retract cam.

The rod and case assembly achieves a compact and reliable configuration, easily installed, having a minimum of parts, while still being reliable and cost effective.

The panic exit device of the present invention provides a push bar which, through the use of a pair of lever devices, laterally thrusts a push plate having a forked end, toward the rod and case assembly. The push plate is laterally guided inside a channeled base. The forked end of the push plate engages a rotatable lift lever which causes the lift lever to pivot and extend upwardly its distal end to raise a lift plate which moves vertically in fixed relationship with the rod slide. Thus, inward thrusting of the panic exit push bar effects a lifting on the rod slide which itself is engaged to the upper and lower latches through the vertically extending rods.

The panic exit device is remarkably simple with a minimum of moving parts.

The panic exit device further provides an actuatable dogging latch which, when the panic exit device is fully compressed, can be actuated to lock the push bar to the base to dog the latches in a disengaged condition. The dogging latch is spring actuated to remain in the undogged condition until a user inserts a tool to displace the latch for hooking engagement with a pin fixed with respect to the base.

Conveniently utilized with the present invention is an upper latch assembly according to U.S. Ser. No. 664,797 filed Mar. 5, 1991 now U.S. Pat. No. 5,114,192, issued May 19, 1992, and a lower latch assembly such as shown in U.S. Pat. No. 4,839,988, both of which disclosures are incorporated herein by reference.

BRIEF DESCRIPTION OF THE DRAWINGS

FIG. 2 is a front elevational view of the rod casing shown in FIG. 1 with a cover partially removed for clarity;

FIG. 3 is a front elevational view of the rod casing of FIG. 1 mounted inside an active door stile and having extending rods and latches;

FIG. 4 is a sectional view of the casing and rod assembly of FIG. 3 taken generally along IV—IV;

FIG. 14 is a front elevational view of a combination rod and casing assembly and a panic exit device of the present invention with a push pad removed for clarity;

FIG. 15 is a sectional view of the assembly in the panic exit device of FIG. 14 taken generally along line XV—XV;

DETAILED DESCRIPTION OF THE PREFERRED EMBODIMENTS

Figure 1:
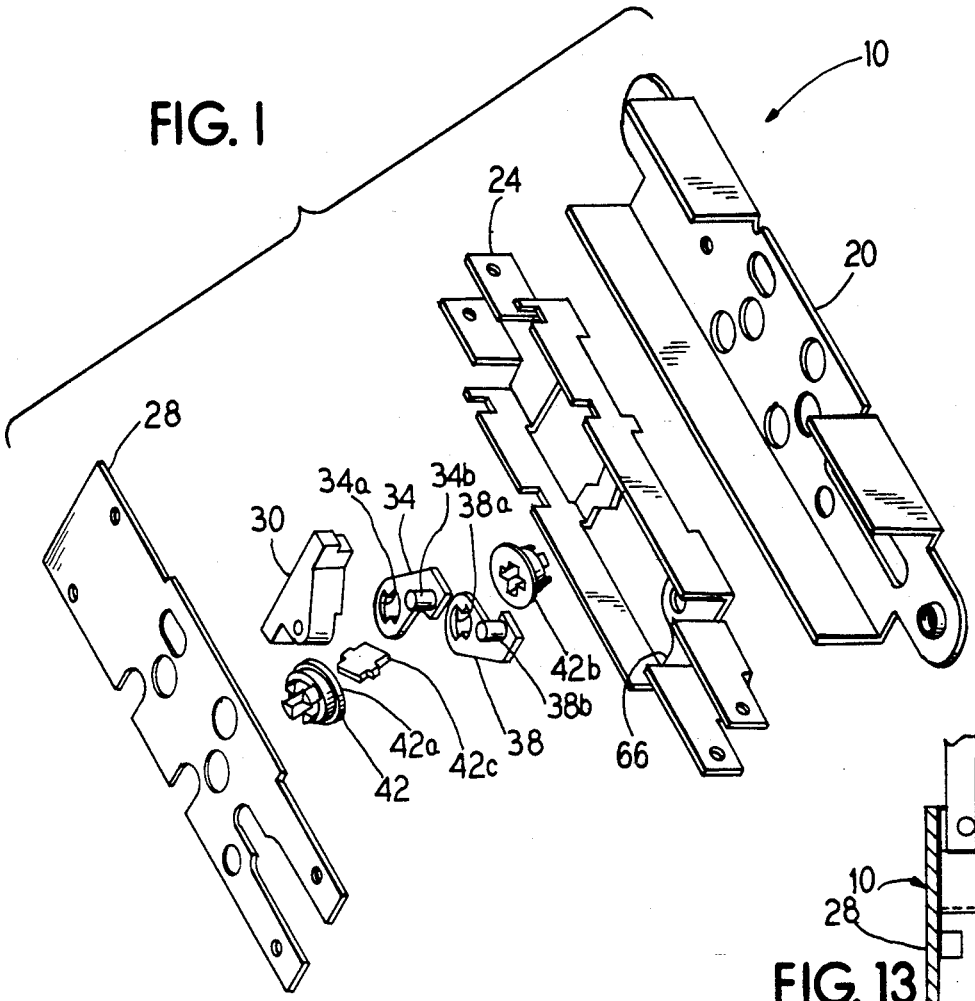
FIG. 1 is an exploded view of the rod casing of the present invention.

FIG. 1 shows an exploded view of the rod casing assembly 10 of the present invention. The casing assembly 10 comprises a chassis 20, a rod slide 24, and a cover 28. Also provided as part of the assembly is a lock/latch retract cam 30, a lock/unlock actuator 34, a latch retract actuator 38, and a cylinder hub 42, comprising in exploded form a left hub 42*a*, a right hub 42*b*, and a spindle piece 42*c*.

FIG. 2 shows the rod casing assembly 10 with portions of the cover 28 removed for clarity. The rod slide 24 fits within the chassis 20 and is held therein in axially sliding fashion. The chassis 20 is provided with axial mounting slots 46 which capture two bolts or pins 48 through the rod slide 24. Therefore, the rod slide 24 can move vertically or axially with respect to the chassis 20. The rod slide 24 mounts at a top end 24*a* a first latch rod 50, and at a bottom end 24*b* a second latch rod 52 for engaging and disengaging a first latch 56 (shown in FIG. 4) and a second latch 58 (shown in FIG. 3) for latching and delatching an active stile 70 of a door 72 to a door frame 74 (shown in FIG. 3).

Mounted in a fixed manner to the rod slide 24 is a lock/latch retract cam 62. The lock/latch retract cam 62 moves vertically with the rod slide 24 within the chassis 20.

Mounted to the cover 28 and the chassis 20 and penetrating an open space 66 at a back of the rod slide 24 is the cylinder hub 42. The cylinder hub 42 acts as an interface between a key cylinder 68 (shown schematically in FIG. 4) and the rod casing assembly 10. Rotation of a key in the key cylinder 68 would impart rotation to the cylinder hub 42 about an axis into the page of FIG. 2.

The cylinder hub 42, when assembled, captures the latch retract actuator 38 and the lock/unlock actuator 34 on its axis of rotation by piercing central apertures 38*a*, 34*a* of the latch retract actuator and the lock/unlock actuator respectively (shown in FIG. 1). These central apertures 34*a*, 38*a* are pierced by the spindle piece 42*c* and are fashioned to be selectively rotatable by the spindle piece 42*c*. Thus, when the cylinder hub 42 is assembled, rotation of the cylinder hub 42 along its axis imparts selective rotation to the latch retract actuator 38 and the lock/unlock actuator 34. However, rotation of the spindle piece 42*c* within the formed apertures 34*a*, 38*a* has sufficient degree of free rotational travel with respect to the latch retract actuator 38 and lock/unlock actuator 34 to selectively rotate the latch retract actuator 38 and the lock/unlock actuator 34 independently in order to perform the required functions.

FIG. 3 shows the rod casing assembly 10 mounted to the active stile 70 of the door 72 fit into the door frame 74. The upward latch 56 is of a type more fully described in pending application Ser. No. 664,797, filed Mar. 5, 1991 now U.S. Pat. No. 5,114,192, issued May 19, 1992, and the lower latch is more fully described in U.S. Pat. No. 4,839,988. A variety of known latches can be utilized with the present invention.

FIG. 4 shows the casing assembly 10 mounted to the door stile 70 by two screws 80*a*, 80*b*. The cylinder hub 42 is shown in a position to be engaged by the lock cylinder 68. It is to be noted from FIGS. 3 and 4 that upward movement of the rods 50, 52 disengages the latches 50, 52.

Figures 5, 6, 7, 8, 9, 10, 11:
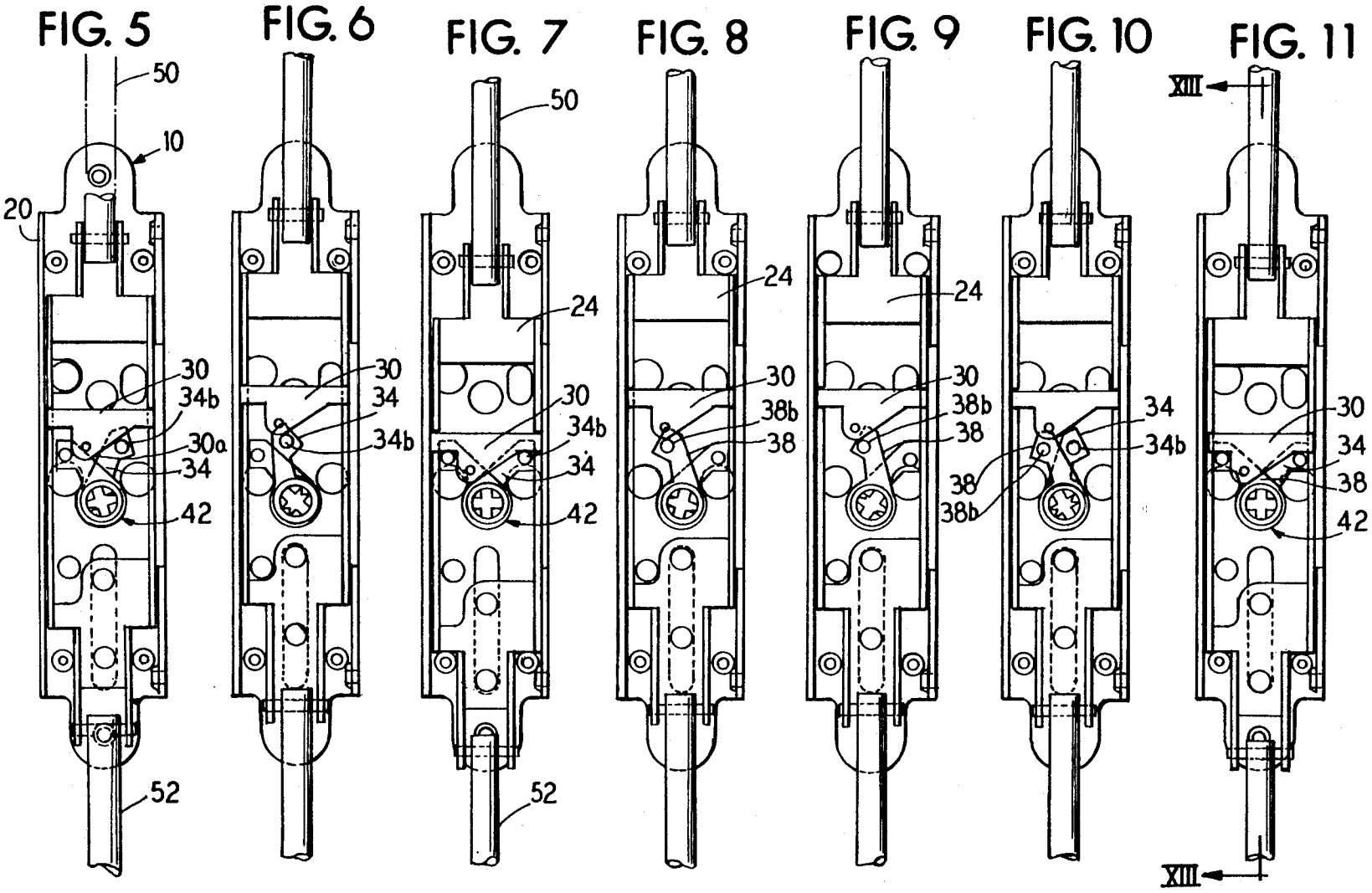
FIGS. 5–11 are front elevational views of the rod casing assembly in particular operational conditions, with a cover removed for clarity.

FIGS. 5-11 show the rod casing assembly 10 in various stages of operation. In FIG. 5 the cylinder hub 42 is being rotated counter clockwise which causes the spindle piece 42*c* to rotate the lock/unlock actuator 34 counter clockwise. The spindle piece 42*c* abuts corners 34*c*, 34*d* to rotate the lock/unlock actuator 34 as can be derived from FIG. 12 for counter-clockwise rotation of the spindle piece 42*c*. The lock/unlock actuator 34 has extending horizontally therefrom a lock actuating pin 34*b* which slides along the cammed surface 30*a* of the cam 30, driving the cam 30 upward which drives the rod slide 24 upward, which drives the rods 50, 52 upward.

FIG. 6 shows the travel of the lock/unlock actuator 34 complete. The latches 56, 58 have been fully retracted (not shown) and the door can be opened. The cam 30 rests upon the actuating pin 34*b*.

FIG. 7 shows the cylinder hub 42 released such as when an operator of a key has released pressure on the key. By the weight of the rods 50, 52, the cam 30 has fallen down with the actuator pin 34*b* riding along the cam surface 30*a* and returning to its original position. This is an "undogged" or "latch activated" condition.

FIG. 8 shows the latch retract actuator 38 rotated clockwise with a dogging actuating pin 38*b* rotated beneath the cam 30 which had been in an elevated position. This positioning of the retract actuator 38 would generally follow the condition shown in FIG. 6 where clockwise rotation of the cylinder hub from the condition of FIG. 6 would permit the retract actuator 38 to displace the lock/unlock actuator 34 to underlie the cam 30.

Figure 12:
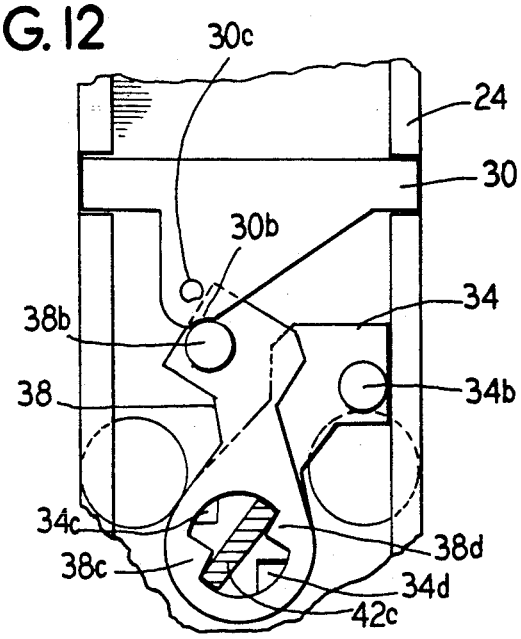
FIG. 12 is an enlarged partial front elevational view of the rod casing assembly of FIG. 9.

FIG. 9 shows the retract actuator 38 rotated further still clockwise. This further rotation occurs against a resilient deformation force of the cam 30. An exemplary material chosen for the retract cam 30 is polycarb LNP-4010 white or natural as this material allows a small amount of resilient compression. As FIG. 12 shows, this resiliency allows for some deformation along an area of contact 30*b* at a trailing end of the cam 30. Additionally, a hole 30*c* is formed into the cam 30 near to the point of contact 30*b* with the retract actuating pin 38*b* which assists, by removing material from the retract cam 30, in this resilient compression of the retract cam 30. This resilient compression provides two benefits, first, it holds or grips the retract actuator firmly in the dogging position or the latch retract position even during the shock and impact that occurs as the door opens and closes to the door frame. Secondly, an additional benefit is that the resilient compression force to be overcome to dog the cam 30 prevents the cam 30 and the retract actuator 38 from accidentally engaging into a dogged or latch retract position at an incorrect time.

FIG. 10 shows the operation for removing the assembly from the dogged position or the latch retract position as shown in FIG. 9. As shown in FIG. 10, the lock/unlock actuator 34, which is arranged behind the latch retract actuator 38 on the cylinder hub 42, interferes with the latch retract actuator 38 by abutting the latch retract actuator 38 with the lock actuating pin 34*b*. This pushes the latch retract actuator counter clockwise past the spring-like resilient capture of the cam 30. After the latch retract actuator has passed the cam 30 the assembly reverts to the undogged or latch activated condition. FIG. 11 shows the assembly fully returned to this condition.

FIG. 12 explains the relationship between the spindle piece 42*c* and the latch retract actuator 38 and the lock/unlock actuator 34. Each of the latch retract actuator 38 and the lock/unlock actuator 34 comprises two corners formed into the interior of the respective apertures 34*a*, 34*b*. The apertures 34*a*, 34*b* are otherwise circular. These corners are arranged to allow approximately 90° of freedom for the spindle piece 42*c* within the apertures 34*a*, 34*b*. The latch retract actuator 38 provides corners 38*c* and 38*d* respectively and the lock/unlock actuator provides corners 34*c*, 34*d* respectively. The arrangement of these corners with the spindle piece 42*c* provides that each of the actuators 34, 38 has approximately 90° of rotational play with regard to the movement of the spindle 42*c* within the respective apertures 38*a*, 34*a*.

With regard to the movement of the mechanism from FIG. 6 to the condition of FIG. 8, when the spindle piece 42*c* is turned clockwise from the condition of FIG. 6 the latch retract actuator 38 moves clockwise before the lock/unlock actuator begins to move clockwise because of the 90° play of the spindle piece 42*c* and the arrangement of the corners 34*c*, 34*d*. Thus, the latch retract actuator 38 is able to underlie the cam surface 30*a* before the cam surface 30*a* proceeds downwardly to any great extent.

Figure 13:
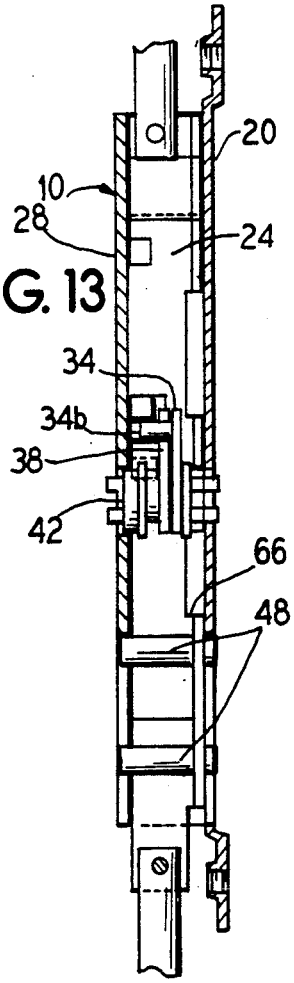
FIG. 13 is a sectional view of the rod casing assembly of FIG. 11 taken generally along line XIII—XIII.

FIG. 13 shows in sectional view the casing assembly 10 including the arrangement of the actuators 34, 38 on the cylinder hub 42. The cover piece 28 is shown mounted to a top of the chassis 20. The cylinder hub 42 is shown mounted through the open back portion 66 of the rod slide 24. Thus, the rod slide 24 can proceed up and down axially without interfering with the cylinder hub 42. The pins 48 are shown in place through the cover 28 and chassis 20.

FIG. 14 shows an alternate assembly wherein the front of the door holds a panic exit device 150 for manually retracting the latch bolts 56, 58. In FIG. 14, the rod and casing assembly 10 has been reoriented for the key cylinder 68 to face a backside of the door, preferably an outside of the inside area from which egress is desired using a panic exit device 150. Mounted fixedly to a backside of the chassis 20 is a base 152 by the use of two spacer studs 154. The spacer studs 154 fixedly attach the base 152 to the housing 20, but at the same time allow a clearance therebetween. Mounted slidingly with respect to the base 152 is a lift plate 158 which has a first hole 160 and a second hole 162 therethrough. The first hole 160 carries a lift pin 166 therethrough and the second hole 162 holds a guidepin 168 therethrough. The lift plate 158 has a circular notch 170 arranged on a lateral side facing the panic exit device 150. The panic exit device has a pivoting lift lever 176 with a rounded end 176*a* interfitting into the rounded notch 170. The lifting lever is pivotally attached by a lift axle 178 to an outwardly extending tab 180 of the base 152. The base 152 thereby comprises generally a T shape turned on its side. The lifting lever 176 comprises a rounded collar portion 182 bounded by a lower shoulder 186 and an upper shoulder 188. The panic exit device has held slidingly therein a push plate 190 which has a forked end 194 which is sized to engage around the collar portion 182.

FIG. 14 shows the latches 56, 58 in an engaged condition with the door frame 74.

FIG. 15 shows in side view the panic exit device 150 and the rod and case assembly 10. The cylinder hub 42 is shown engaged to the lock cylinder 68. The interaction between the panic exit device and the rod and case assembly as previously described is explained in this figure. The base 152 is shown mounted to the chassis 20 using the spacer studs 154. The lift pin 166 is shown piercing the hole 160 of the lift plate, penetrating the base 152 through a slot 200 (shown in FIG. 16), penetrating the slot 46 of the chassis 20 (shown in FIG. 2) and engaged through the aperture 48' of the rod slide (shown in FIG. 2). Thereby, an upward lifting force on the lift plate 152 translates the lift pin upwardly through the slots 200, 46, and by virtue of piercing the aperture 48' of the rod slide 24 lifts the rod slide with the lift plate 152. A lock ring 166*a* can be used on the outward side of the lift pin 166 to lock the lift pin in place. Additionally, a threaded screw 166*b* can be used to lock the lift pin on the rod slide end. Above the lift pin 166, the guidepin 168 is shown guiding vertical movement of the lift plate 158 with respect to the base 152. The guidepin 168 is fitted through the aperture 162 and the lift plate 158 and resides in a second slot 206 in the base 152 (shown in FIG. 16).

The panic exit device 150 provides a push pad 210 compressively mounted to a base channel 214.

Figure 16:
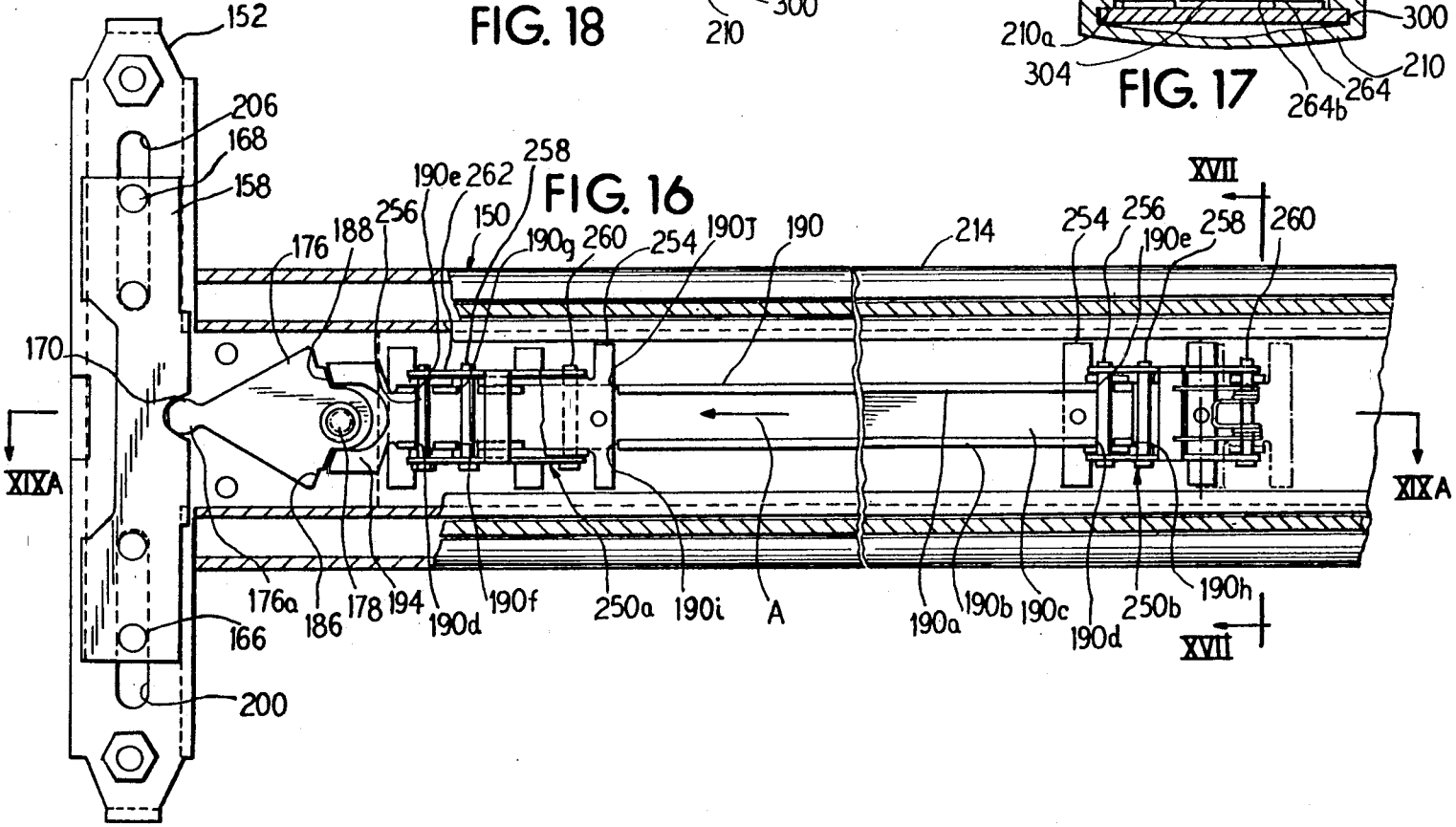
FIG. 16 is an enlarged partial elevational view of the panic exit device and rod and casing assembly of FIG. 14.

FIG. 16 shows in more detail the working of the panic exit device 150. The lifting lever 176 is shown in an orientation lifted from the orientation shown in FIG. 14. In this condition, the panic exit device 150 has been compressed by a user and the lift plate 158 has been raised by the lifting lever 176 which has lifted the rod slide 24 and retracted the latch bolts 56, 58. The lifting lever 176 is shown with its rounded end 176*a* interfit into the rounded notch 170 of the lift plate 158, as the lifting lever 176 is pivoted upward, the rounded end 176*a* pivots inside the rounded portion 170. The lifting lever 176 pivots about the lift axle 178. Translation of the push plate 190 in the direction of arrow A pushes the forked end 194 against the lower shoulder 186 of the lifting lever 176 until the upper shoulder 188 abuts the forked end 194. The push plate 190 is translated by two motion actuators 250*a*, 250*b*.

The motion actuators 250*a*, 250*b* transform the inward thrusting movement of the push pad 210 into a lateral translating movement in the direction of the arrow A. Each motion actuator comprises an assembly having a push pad base 254; a first axle 256, a second axle 258; and a third axle 260; all axles held by a lever arm 262, the lever arm 262 held by a push pad bracket 264 (shown in FIG. 19*a*).

The push plate 190 has formed thereon and extending outwardly, a discontinuous pair of flanges 190*a*, 190*b* which form, with a back surface 190*c* of the push plate 190 a C-shape or channeled cross section. The flanges 190*a*, 190*b* are discontinuous to form notches 190*d*, 190*e* for interfitting therein the first axle 256 of each actuator 250*a*, 250*b*. By fitting the first axles 256 into the notches 190*d*, 190*e* translation force of the axles in a direction A will push or translate the push plate 190 in a direction A. An additional set of notches 190*f*, 190*g* are provided to allow for noninterference between the second axle 258 and the push plate 190 as the push pad 194 is depressed and the motion actuator 250*a* is thereby compressed. The push plate 190 is sized in length to terminate at an end 190*h* so that additional notches are not required to allow for noninterference with the second axle 258 of the second motion actuator 250*b*. A further, wider notch 190*i*, 190*j* is provided adjacent to the notches 190*f*, 190*g* to allow for noninterference with the third axle 260 and associated parts during compression of the first actuator 250*a*. Because the push plate 190 is terminated at the end 190*h*, no such notches are needed for the second motion actuator 250*b*.

Figure 17:
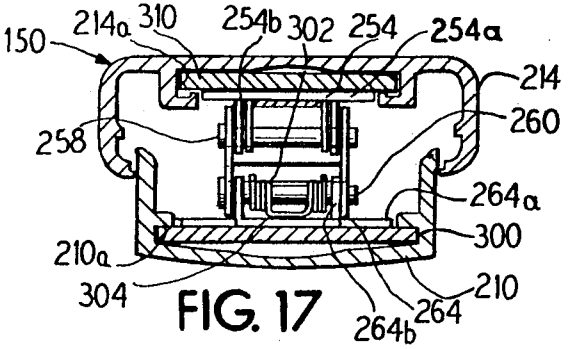
FIG. 17 is a sectional view taken generally along line XVII—XVII of FIG. 16.

FIG. 17 shows some construction details for the present invention. The push pad 210 provides a channel 210*a* for holding on an underside thereof a mounting plate 300. The mounting plate 300 holds thereon the push pad base 264 such as by screws. The push pad bracket 264 comprises a bracket plate 264*a* for mounting to the plate 300 and an inwardly extending C-shaped journal 264*b* for holding the third axle 260 therethrough. A spring 302 is wound around the third axle 260 and is pressed at a central portion 304 against the bracket plate 264*a*. Opposite ends of the spring 302 are biased against a cross beam 262*a* of the lever arm 262 (see FIG. 19*a*). The base channel 214 has a pocket 214*a* formed on an inside thereof to hold a channel base plate 310 which mounts thereon the push pad base 254 which includes a pad baseplate 254*a* which extends into a C-shaped slot journal 254*b* described hereinafter.

Figure 18:
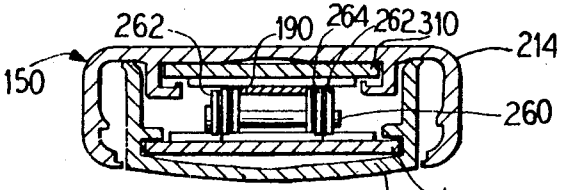
FIG. 18 is a sectional view of the panic exit device of FIG. 17, but in a depressed condition.

FIG. 18 shows the panic exit device 150 in a compressed condition, wherein the bracket 264 has been brought close to the channel base plate 310 and the third axles 260 have been brought generally aligned with the first and second axle pairs 256, 258.

Figure 19C:
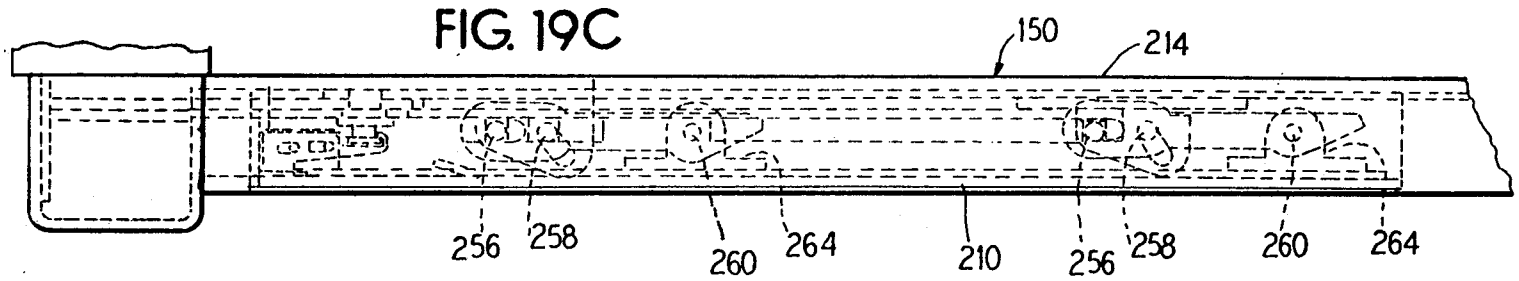
FIG. 19*a*-19*c* are sectional views taken generally along line XIXa—XIXa of FIG. 16 in three stages of compression.
Figure 19B:
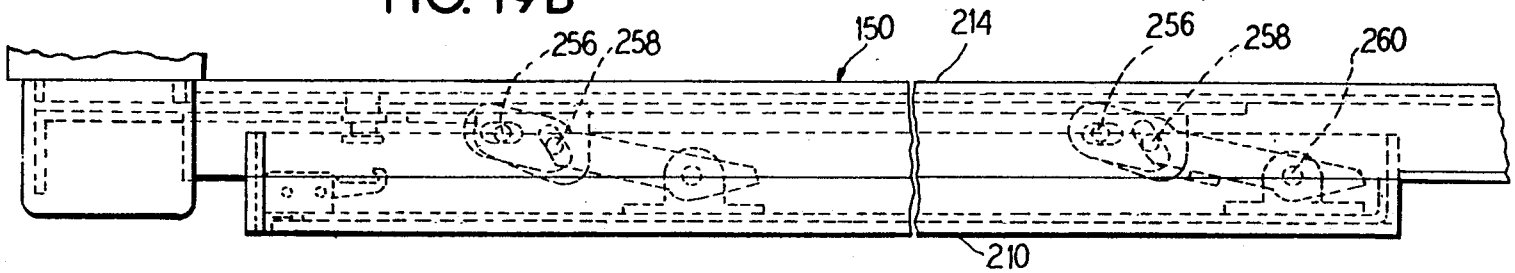
Figure 19A:
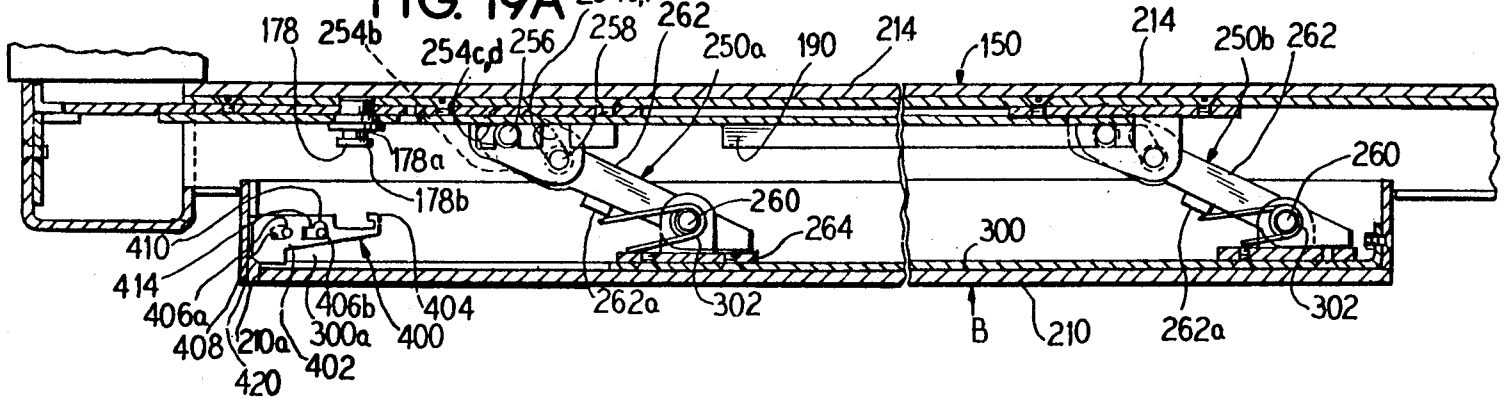

FIGS. 19*a*–19*c* show the progressive compression of the panic exit device 150 and the action of the various cooperating parts. When the push pad 210 is progressed toward the base channel 214 to compress the panic exit device 150, the lever arms 262 pivot about the third axle 260 at both the first motion actuator 250*a*, and the second motion actuator 250*b*. Each C-shaped slot journal 254*b* of the push pad base 254 is formed with first upper and lower congruent slots 254*c*, *d* and second upper and lower congruent slots 254*e*, *f*. The first slots 254*c*, *d* capture the first axle 256 therethrough and the second slots 254*e*, 254*f* capture the second axle 258 therethrough. The first slots 254*c*, *d* are arranged elongated in a lateral direction of the arrow A and the second slots 254*e*, *f* are elongated in a direction inclined to both the lateral direction arrow A and the direction arrow B with a vector component in the direction of arrow B and a vector component in the direction of arrow A as the second axles 258 progress through the slots 254*e*, *f*. As the push pad 210 is progressed inwardly, the second axles 258 progress through the slots 254*e*, *f* with also a freedom of axial rotation and the first axle 256 proceeds laterally through the slots 254*c*, *d* also with a freedom of axial rotation. The effect of this arrangement is that the motion in a direction of arrow B of the push pad creates a lateral translation of the first axle 256 which pushes the push plate 190 in a direction A. Because of the orientation and angularity of the slots 254*c*, *d* and 254*e*, *f*, the push pad B can proceed directly inwardly without shifting either to the left or right of FIG. 19*a* during inward progression. The springs 302 bias the push pad 210 outwardly, such bias overcome by a user when progressing the push pad 210 inwardly.

FIG. 19*a* also shows a dogging device shown generally at 400 for dogging the push pad 210 compressed with the channel 214. The dogging device comprises a lever 402 having a hook end 404 which is fashioned to be able to engage into a groove 178*a* of the lift axle 178. The lever 402 is attached by two pins 406*a*, 406*b* to the base 300 of the push pad 210. A pair of flanges 300*a* are provided inwardly of the mounting plate 300 for holding the pins in a journaled or trunnion-like arrangement, only the bottom flange 300*a* is shown in FIG. 19*a* for clarity. The lever 402 is fashioned with two slots. A first slot 408 is elongated in the direction of arrow A. A second slot 410 is elongated according to an L shape both in the direction of arrow A and in the direction of arrow B. In normal use, the hook end 404 is arranged to abut a top surface 178*b* of the lift axle 178, so that no hooking into the channel 178*a* occurs. A spring 414 located in the second slot 410 in the A direction biases the hook end 404 in this orientation. When the hook end 404 abuts the surface 178*b*, the second slot 410 having freedom of movement in the direction B because the shape of the second slot, the hook end can deflect upon interference in the direction of arrow B.

When dogging of the panic exit device 150 is desired, a screwdriver or other type tool is inserted into a slot 210*a* formed in the push pad 210 to abut an angled surface 420 of the lever 402 which thrusts the lever against the bias of spring 414 directly opposite to the pointing direction of arrow A. When this occurs, the hook end 404 moves past the surface 178*b* and is laterally positioned to be able to hook into the slot 178*a* as shown in FIG. 19*c*. When the tool is released from the angled surface 420, the hook end 404 can rebound slightly in the pointing direction of arrow A to complete engagement with the groove 178*a* which accomplishes dogging of the push pad 210 to the channel 214 as shown in FIG. 19*c*.

The rod slide, actuators and other hardware associated with the panic exit device and latching mechanisms are preferably made of steel or other known metals for door hardware applications.

Although the present invention has been described with reference to a specific embodiment, those of skill in the art will recognize that changes may be made thereto without departing from the scope and spirit of the invention as set forth in the appended claims.

I claim as my invention:

1. A panic exit device for mounting to a surface of a door, wherein the door provides at least one latch for engaging a door frame adjacent the door, comprising:

a lift plate mounted slidably with respect to the door;

linkage means for translating movement of said lift plate to delatch said latch from the door frame;

a lift lever mounted pivotally at a base end thereof to the door, and engaged at an opposite end thereof to said lift plate;

a push plate mounted laterally slidable with respect to said door and abuttable at a lead end to an offset portion of said lift lever to effect pivoting of said lift lever;

at least one motion actuator means, compressible in a direction normal to the surface of said door, engaged to said push plate and arranged to translate said compression to a lateral thrust on said push plate; and a push pad mounted to the door in compressible fashion, overlying said motion actuator means, said motion actuator means engaged to said push pad, thrusting of said push pad toward said door causing compression of said motion actuator means.

2. The panic exit device according to claim 1, wherein the opposite end of said lift lever is rounded, and said lift plate provides a rounded compatibly shaped notch for interfitting of said rounded end into said notch for engagement of the lift lever with said lift plate.

3. The panic exit device according to claim 1, wherein said base end of said lift lever comprises a rounded collar having two shoulder portions adjacent said rounded collar; and said push plate has a forked end facing said lifting lever, said forked end arranged and adapted to surround said collar and abut said shoulders when translated against said lifting lever.

4. The panic exit device according to claim 1, wherein said motion actuator means comprises a lever arm mounted pivotally at a first end thereof to said push pad and mounted slidably at a second end thereof with respect to said door, said lever arm having a pin means engaged with said push plate to thrust said push plate laterally with respect to said door when said motion actuator means is compressed.

5. The panic exit device according to claim 4, wherein said motion actuator means comprises a mounting bracket mounted fixedly with respect to said door, said mounting bracket providing a slot elongated in a direction parallel to the surface of the door and a second slot arranged elongated in a direction inclined to the surface of the door;

said pin means comprises a first axle captured in said first slot and said lever arm comprises a second axle captured in said second slot.

6. The panic exit device according to claim 5, wherein said push plate provides a flange portion extending from said push plate outwardly toward said push pad, said flange portion abuttable by said first axle.

7. The panic exit device according to claim 5, wherein said motion actuator means further comprises a spring member, said spring member mounted to exert a bias between said lever arm and said push pad.

8. The panic exit device according to claim 5, wherein said motion actuator means comprises two motion actuators arranged laterally spaced apart along the length of said push plate.

9. The panic exit device according to claim 5, wherein said lever arm comprises a third axle and said push pad comprises a mounting journal having an aperture therethrough and said third axle is captured in said aperture to provide said pivotal mounting between said push pad and said first end of said lever arm.

10. The panic exit device according to claim 5, wherein a channel base is mounted to said door between said door and said mounting bracket, said channel base providing a mounting surface to hold said bracket, said channel base arranged and adapted for said push plate to be guided laterally within said channel base.

11. The panic exit device according to claim 5, wherein the opposite end of said lifting lever is rounded, and said lift plate provides a rounded compatibly shaped notch for interfitting of said rounded end into said notch for engagement of the lift lever with said lift plate.

12. The panic exit device according to claim 5, wherein said base end of said lift lever comprises a rounded collar having two shoulder portions adjacent said rounded collar; and said push plate has a forked end facing said lifting lever, said forked end arranged and adapted to surround said collar and abut said shoulders when translated against said lifting lever.

13. The panic exit device according to claim 1 further comprising a dogging lever, said dogging lever slidably mounted to said push pad, said dogging lever having a hook at an end thereof;

a catch means, said catch means mounted fixedly with respect to said door in alignment with said hook in a direction of compression of said push pad toward said door;

said hook displaceable laterally manually in a first direction to misalign with said catch and returnable in a direction opposite to the first direction to engage with the catch means when the push pad is in a compressed condition with respect to the door.

14. The panic exit device according to claim 13, wherein said dogging lever is arranged to have an inclined surface with respect to an outer surface of said push pad, and said push pad provides a slot on said outer surface aligned overlying said inclined surface, insertion of a pushing tool through said slot to push said inclined surface causing said dogging lever to be displaced laterally in said first direction.

15. The panic exit device according to claim 14, wherein said catch means comprises a groove formed in a lift axle serving to pivotally mount said lift lever at said base end thereof, said hook engageable into said groove.

16. The panic exit device according to claim 15, wherein said dogging lever comprises a first mounting slot arranged elongated in a direction of approach between said dogging lever and said catch and also elongated in a lateral direction forming an L-shaped slot; and a second slot elongated in the lateral direction; and said push pad provides a mount for said dogging lever providing pins connected to said mount and captured one within each of said first and second slots, said pins allowing said dogging lever to be displaced laterally with said pins progressing through said first and second slots and also allowing said hook to be displaced parallel to a direction of approach between said push pad and said door when said hook and said catch means abut.

17. A door latching/unlatching assembly for mounting to a door adjacent a door frame, comprising:

a latch member mounted to said door in a fashion to be extendable to engage a receiving portion of the door stile for latching the door to the door stile;

a chassis mounted to the door;

an actuator means for retracting the latch from the door frame, said actuator means mechanically connected to said latch, said actuator means slidably mounted to said chassis for vertical movement with respect to said chassis, said actuator means having a trailing portion thereon;

a delatch means mounted to said chassis but having at least one degree of freedom for movement, said delatch means movable to underlie said trailing portion for dogging said actuator means in a vertically raised position;

a lock/unlock means mounted to said chassis having at least one degree of freedom for movement and having an abutment portion engageable with the trailing portion of said actuator means for imparting an upper thrust on said actuator means when said lock/unlock means is selectively moved; and a rotation means, mounted to said chassis, for receiving a selective rotation signal from the user and for selectively moving said lock/unlock means and said delatch means; and a manual push pad mounted on a first face of the door;

a lifting lever mounted rotatably with respect to the door and having a distal swinging end and mechanically linked to said actuator means;

a push plate engaged to a base end of said lifting lever and arranged beneath said push pad, laterally guided with respect to the door;

means for transforming inward thrust on said push pad to a lateral thrust on said push plate, said push plate thrusting on a base end of said lifting lever to cause said lifting lever to pivot and translate the actuator means vertically.

18. The assembly according to claim 17, wherein said rotation means comprises a key cylinder for receiving a key, said key rotated by a user.

19. The assembly according to claim 18, wherein said chassis provides a slot therethrough; and said actuator means comprises a rod slide and a rod mechanically linking said rod slide and said latch; and said assembly comprises a lifting plate mounted on an opposite side of said chassis with a pin member connecting said rod slide and said lifting plate together through said slot of said chassis allowing said rod slide and lifting plate to move vertically with respect to said chassis with said pin member passing through said slot.

20. The panic exit device according to claim 19, wherein said means for transforming comprises a lever arm mounted pivotally at a first end thereof to said push pad and mounted slidably at a second end thereof with respect to said door, said lever arm having a pin means engaged with said push plate to thrust said push plate laterally with respect to said door when said means for transforming is compressed.

21. The panic exit device according to claim 20, wherein said means for transforming comprises a mounting bracket mounted fixedly with respect to said door, said mounting bracket providing a slot elongated in a direction parallel to the surface of the door and a second slot arranged elongated in a direction inclined to the surface of the door; and said pin means comprises a first axle captured in said first slot and said lever arm comprises a second axle captured in said second slot.

22. The panic exit device according to claim 21, wherein said lever arm comprises a third axle and said push pad comprises a mounting journal having an aperture therethrough and said third axle is captured in said aperture to provide said pivotal mounting between said push pad and said first end of said lever arm.

* * * * *